US006543844B1

(12) United States Patent
Ryan et al.

(10) Patent No.: US 6,543,844 B1
(45) Date of Patent: Apr. 8, 2003

(54) SEATING FURNITURE FOR CHILDREN

(75) Inventors: Stephen Ryan, Mississauga (CA); Gloria Leibel, North York (CA); Michael Doell, Toronto (CA); Alan Barber, Toronto (CA); Shone Stickel, Toronto (CA)

(73) Assignee: Bloorview MacMillan Centre, Toronto (CA)

( * ) Notice: Subject to any disclaimer, the term of this patent is extended or adjusted under 35 U.S.C. 154(b) by 0 days.

(21) Appl. No.: 09/702,821

(22) Filed: Nov. 1, 2000

Related U.S. Application Data

(63) Continuation-in-part of application No. 29/118,675, filed on Feb. 15, 2000, now Pat. No. Des. 441,245.

(51) Int. Cl.[7] ..... A47D 15/00

(52) U.S. Cl. ..... 297/219.12; 297/452.26; 297/452.35

(58) Field of Search ..... 297/219.12, 229, 297/452.21, 452.25, 452.26, 452.28, 452.35

(56) References Cited

U.S. PATENT DOCUMENTS 4,912,788 A * 4/1990 Lonardo ..... 297/452.26
5,056,533 A * 10/1991 Solano ..... 297/219.12
5,833,319 A * 11/1998 Davis ..... 297/452.21
5,842,739 A * 12/1998 Noble ..... 297/219.12

FOREIGN PATENT DOCUMENTS

GB 1053540 * 1/1967 ..... 297/452.26

* cited by examiner

*Primary Examiner*—Peter R. Brown
(74) *Attorney, Agent, or Firm*—Bereskin & Parr

(57) ABSTRACT

A support cushion for children's furniture defines a seat cushion area and a back cushion area and has a seating surface that extends over those areas and is contoured to provide positional support and comfort for a child seated on the cushion. The cushion preferably is a one-piece closed cell foam moulding which is flexible to permit variation in the relative angular orientation between the seat cushion and the back cushion area. The seat includes a raised transverse barrier that is spaced forwardly of the rear of the seat for controlling rotation of the pelvis of a child. The cushion further includes a pair of side support pads that extend forwardly from respectively opposite sides of the back to locate against the trunk of a child and cushion against side-to-side movement.

7 Claims, 5 Drawing Sheets

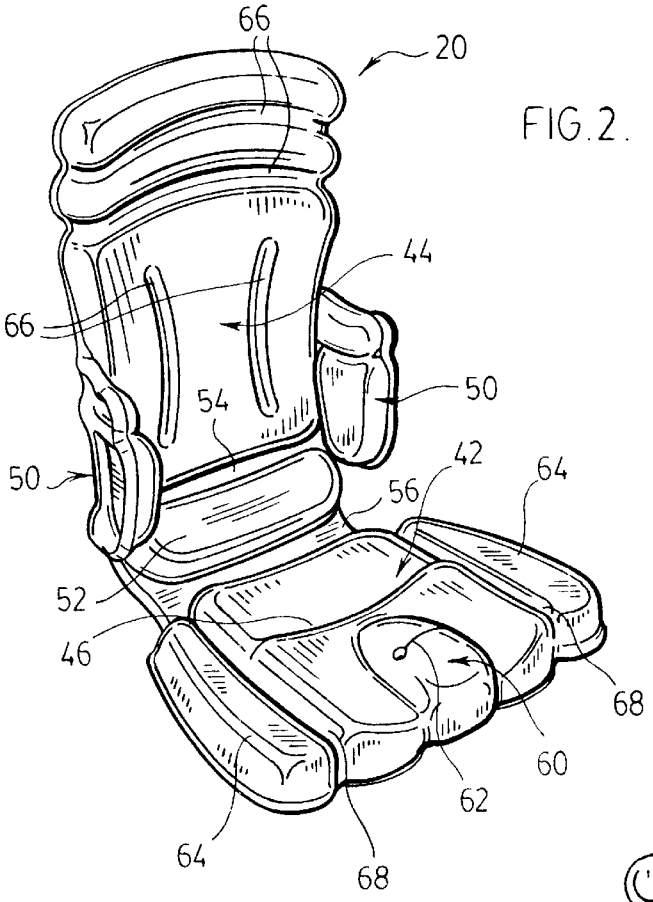
FIG. 2.
FIG. 3.
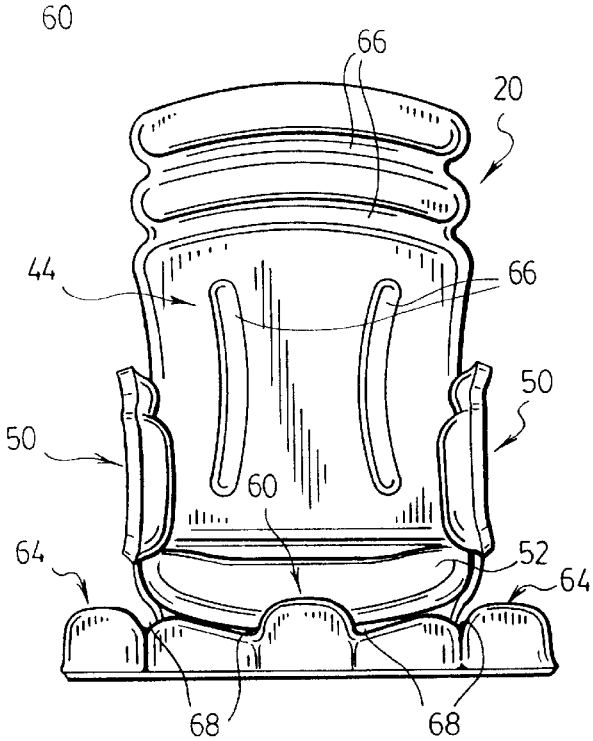

SEATING FURNITURE FOR CHILDREN

CROSS-REFERENCED TO RELATED APPLICATION

This application is a continuation-in-part of design patent application Ser. No. 29/118,675 filed Feb. 15, 2000 now U.S. Pat. No. D.444,245.

FIELD OF THE INVENTION

This invention relates generally to seating furniture for children.

BACKGROUND OF THE INVENTION

Furniture that incorporates so-called "adaptive" seating systems plays an important role in the lives of many children with disabilities. These systems keep children comfortable and secure while they are seated. Adaptive seating systems make it easier for children to breathe, eat and communicate.

Preschoolers with positioning problems often do not need full-support seating systems and do not use wheelchairs, but may require some supplementary support in a simple wheeled mobility base. Parents are also concerned about the cost, portability, versatility and appearance of specialty seats that are available for young children with disabilities.

Service providers and families often use makeshift adaptations for commercial strollers or high chairs to better position a child's trunk, pelvis and head. Rolled towels and foam blocks are inexpensive solutions though parents complain about their long term utility, reliability and appearance. Parents and therapists have identified the need for an alternative positioning device that is inexpensive, is lightweight and addresses the shortcomings of these other approaches and technologies.

SUMMARY OF THE INVENTION

In accordance with the invention there is provided a support cushion for children's furniture in which the cushion defines a seat cushion area and a back cushion area and has a seating surface that extends over those areas and is contoured to provide positional support for a child seated on the cushion. The cushion is flexible to permit variation in relative angular orientation between the seat cushion area and the back cushion area. The seat cushion area includes a raised barrier that extends transversely of the area at a location spaced forwardly of the rear of the seat cushion area for controlling the position of the pelvis of a child using the cushion. The cushion further includes a pair of side support elements that are capable of extending forwardly from respectively opposite sides of the back cushion area to locate against sides of the trunk of a child and cushion against side-to-side movement of the child.

The support cushion provided by the invention can be inserted into a conventional seating system such as a stroller, high chair, bath seat or the like and provides additional positional control beyond that provided by the seating system itself. In other words, the insert can be used with a conventional stroller, for example, and will provide additional positional support for a disabled child while retaining a substantially normal external visual appearance. This can be important in terms of avoiding or minimizing any stigma that may derive from the disability.

When used in commercial children's seating systems, the cushion improves comfort and postural control by encouraging a child to sit upright, view and actively participate in their environment and use their hands more functionally to play and eat.

Although the cushion is particularly well suited for positioning children with disabilities, it can benefit all children by improving and augmenting the postural control offered by umbrella strollers and other children's furniture.

Preferably, the support cushion is made from a foam material that is resilient while providing firm support. For example, the cushion may be made of a closed cell polyethylene foam material.

The cushion should be contoured to keep a child well-supported, improve posture, reduce slouching and promote longer sitting tolerance. As noted previously, the seat area has a raised barrier (preferably of constant height)-called the ischial shelf-that extends the width of the seat. This local deviation in seat elevation creates a bucketed area for the buttocks and helps to control rotation of the pelvis. The ischial shelf acts to keep the pelvis in a neutral position by preventing the ischial tuberosities from migrating forward causing slouching at the back and posterior pelvic tilt.

Side support elements (side pads) are also provided to support the upper trunk of the child. By placing the back of the cushion between the uprights of the stroller or chair, the pads are positioned inward to contact the trunk. This assists in maintaining a more upright posture.

A raised central portion may be provided on the distal section of the seat to assist in maintaining abduction of the legs, creating a more stable base of support and improved symmetrical positioning through the hips as well as placing the pelvis in a better functional position. This raised portion (or "pommel") may extend locally beyond the seat's distal edge to prevent abnormal patterns of seated posture.

A transverse slot located at the mid-point of the pommel may be provided to allow the crotch strap of commercial children's furniture to be used to hold both the child and seat cushion in place.

Higher sides may be provided at the lateral edges of the seat help to hold the thighs in neutral rotation and proper alignment.

BRIEF DESCRIPTION OF DRAWINGS

In order that the invention may be more clearly understood, reference will be made to the accompanying drawings which illustrate a particular preferred embodiment of the invention, and in which:

FIG. 2 is a three-quarter perspective view from above of the cushion as shown in a typical position of use, for example, as in FIG. 1;

FIGS. 3 and 4 are front and rear elevational views respectively corresponding to FIG. 1;

DESCRIPTION OF PREFERRED EMBODIMENT

Figure 1:
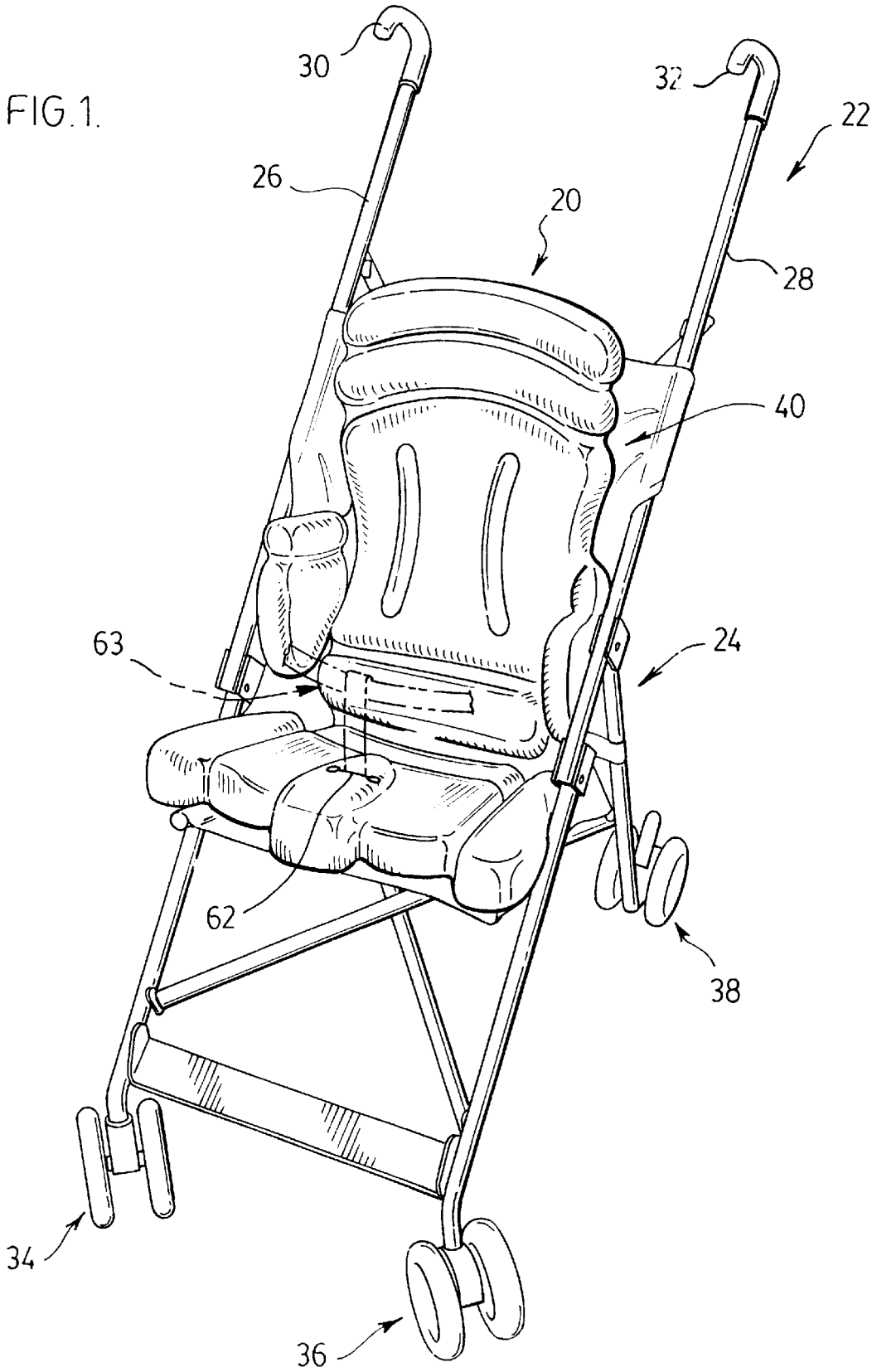
FIG. 1 is a three-quarter perspective view showing the seat and back cushion of the invention in place in a conventional umbrella stroller.
Figure 8:
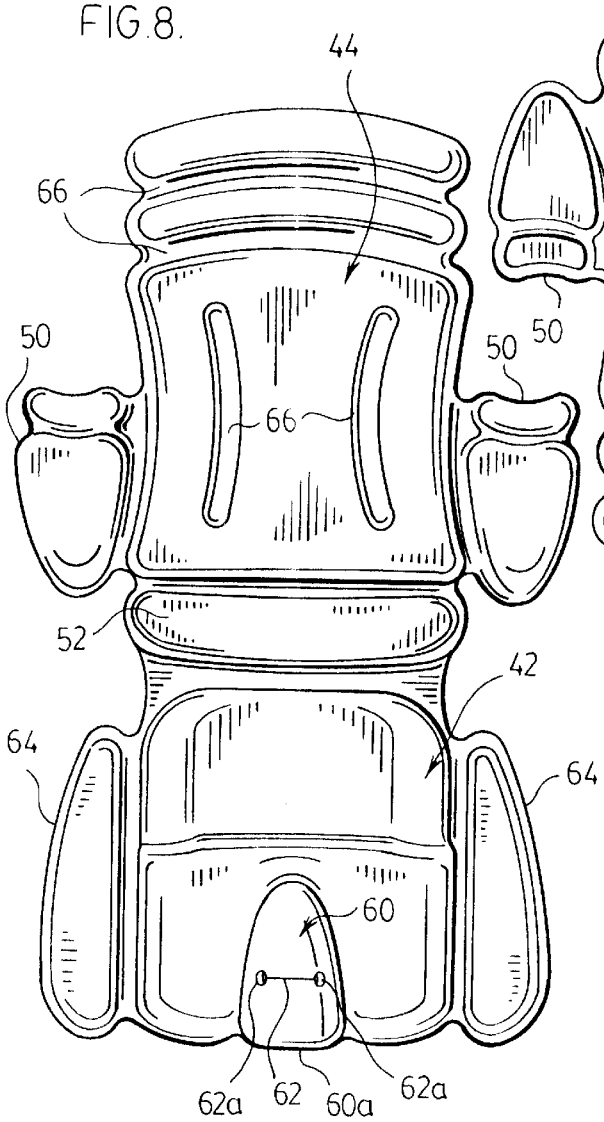
FIGS. 8 and 9 are top and bottom plan views respectively showing the cushion in a flat configuration.
Figure 9:
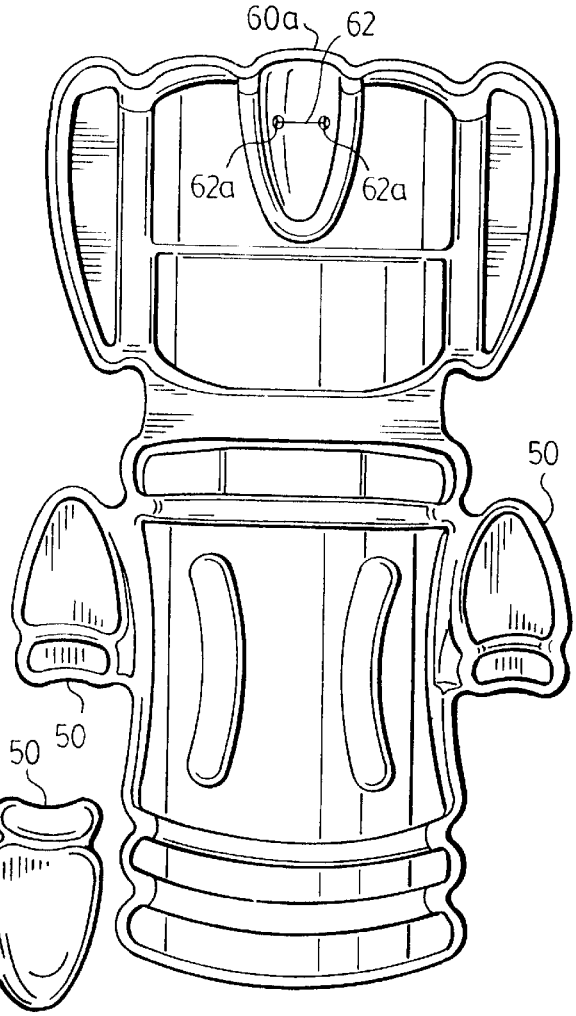

In the drawings, FIG. 1 shows a support cushion in accordance with a preferred embodiment of the invention installed in a so-called "umbrella" stroller for a child, while FIGS. 2 to 9 show the cushion itself in detail. FIGS. 2 to 7 show the cushion in a typical configuration for use, as for example, in FIG. 1, while FIGS. 8 and 9 show the cushion in a flat configuration, for example, as for shipping or storage.

Figure 4:
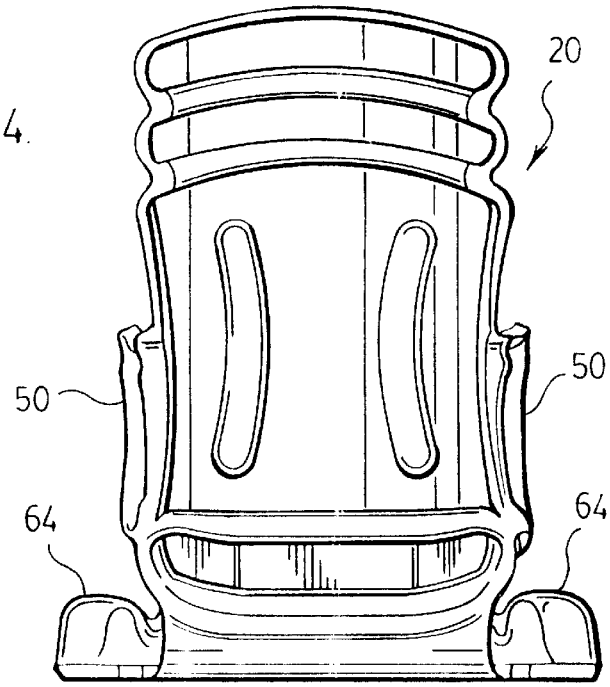
Figure 6:
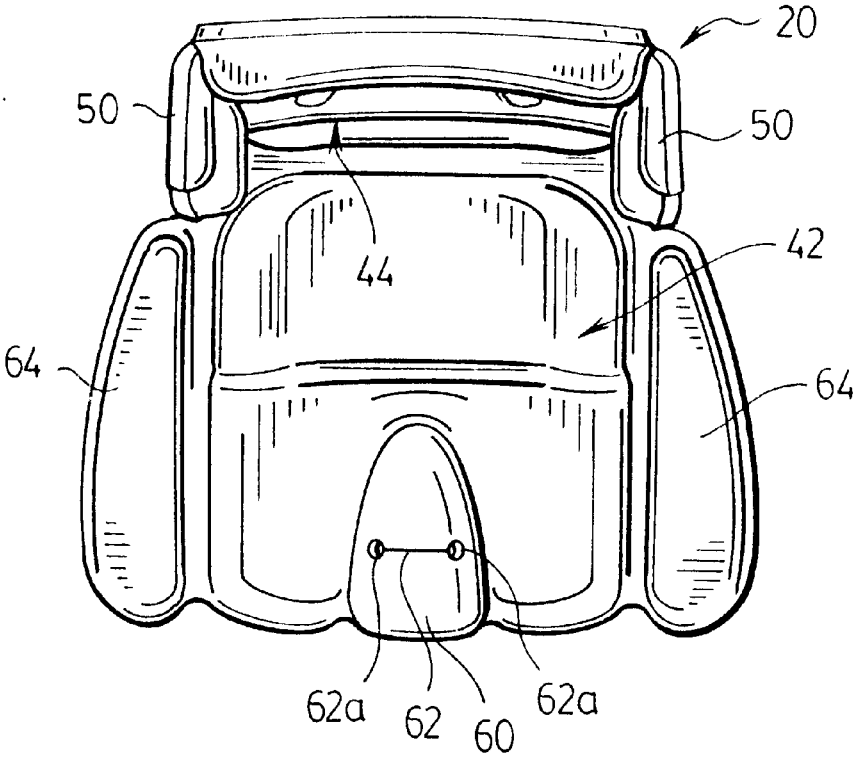
FIGS. 6 and 7 are top and bottom plan views respectively.
Figure 7:
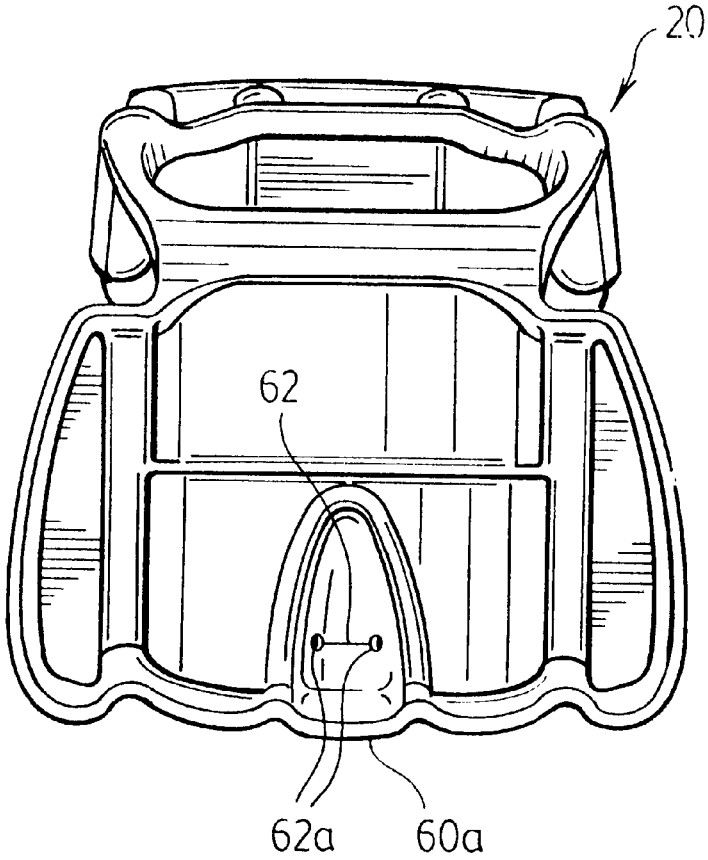

In FIG. 1, the support cushion is generally indicated by reference numeral 20 and the stroller by reference numeral 22. The stroller itself is conventional and therefore will not be described in detail. It is sufficient to note that the stroller includes a collapsible frame 24 including two main uprights 26, 28 that have umbrella-like handles 30, 32 at their upper ends and incline downwardly towards front sets of wheels 34, 36 at their lower ends. The frame also includes rear sets of wheels, one of which is visible at 38. The frame 24 is collapsible from the normal position of use in which it is shown in FIG. 4 to a compact folded position (not shown) in which the uprights 26, 28 are folded close to one another and the stroller can be carried by the handles 30, 32.

A canvas or like fabric sling 40 is carried by the frame and forms the actual seat in which a child can sit. In the normal position of use of the stroller as seen in FIG. 1, the canvass sling hangs down between the two uprights 26, 28 and forms a bucketed or recessed area in which the child sits. While the fabric nature of the sling allows the frame to readily be collapsed for carrying or storage, the child is not firmly held or supported.

The support cushion 20 is a polyethylene foam moulding that is contoured to improve and augment the postural control offered by the umbrella stroller (or other seating unit).

Referring now to FIGS. 2 to 9, the support cushion 20 includes a seat cushion area generally denoted 42 and a back cushion area 44 and has a seating surface that extends over those areas and is contoured to provide positional support for a child seated on the cushion. From a comparison of FIGS. 8 and 9 with FIGS. 2 to 7, it can be seen that the cushion is flexible so that its configuration can be changed and in particular to permit variation in the relative angular orientation between the seat cushion area 42 and the back cushion area 44.

The seat cushion area 42 includes a raised barrier 46 that extends transversely of the area at a location spaced forwardly of the rear of the seat for controlling rotation of the pelvis of a child using the cushion. This effect can best be seen in FIG. 5, where an outline of a child using the cushion is indicated at 48 and the pelvis of the child is represented at 48*a*. It will be seen that the barrier or shelf 46 (known as the "ischial shelf") creates a bucketed area rearwardly of the shelf for the buttocks of the child. At the same time, the shelf helps to control rotation of the pelvis by providing an abutment that tends to resist forward migration of the pelvis (which otherwise leads to rotation of the hips of the child and slouching of the back). In other words, the ischial shelf 46 helps to ensure that the child sits upright.

At opposite sides of the back cushion area 44 are a pair of side support elements 50 that extend forwardly from opposite sides of the back cushion area 44 to locate against the sides of the trunk of a child and cushion the trunk against side-to-side movement. The side support elements or pads 50 extend forwardly below the armpits of the child, on opposite sides of the trunk and tend to hold the child upright, supported by the frame members 26, 28 of the stroller (see FIG. 1).

Figure 5:
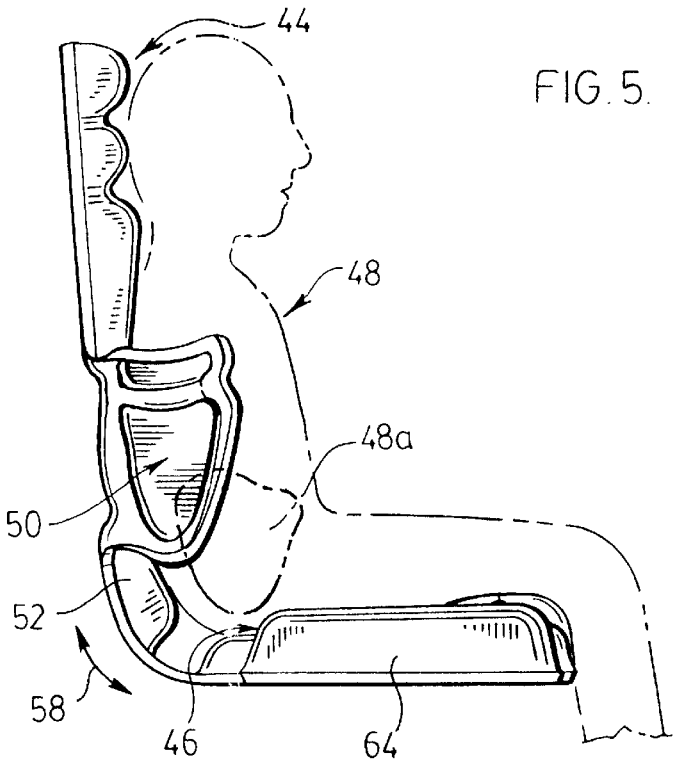
FIG. 5 is an elevational view from the left in FIG. 2.

Between the seat cushion area 42 and the back cushion area 44 is a pelvis support element 52 that extends from side-to-side of the support cushion. As best seen in FIG. 5, element 52 is located directly behind the pelvis 48*a* of the child 48 and provides a firm support that further helps to assure proper posture.

Above and below element 52, the support cushion includes relatively thin and flexible "hinge" areas 54, 56 that allow the cushion to be adjusted to vary the relative depth of the seat and back area of the cushion. For example, the arrow denoted 58 in FIG. 5 illustrates how the cushion may be in effect rotated to either move element 52 down so that it is located to a greater extent below the buttocks of the child, thereby increasing the length of the seat area of the cushion, or to rotate the cushion in the opposite direction to reduce the extent of the seat area.

The seat cushion area 42 is also contoured to provide a raised central area or "pommel" 60 in the distal region of the seat. This assists in maintaining separation between the legs of the child, creating a more stable base of support and improve symmetrical positioning through the hips, as well as placing the pelvis in a better functional position. As best seen in FIGS. 8 and 9, the pommel extends slightly beyond the distal edge of the seat (as indicated at 60*a*) and helps to prevent abnormal patterns of seat posture. A slit 62 is seen extending through the pommel so that a strap or belt connected to the stroller itself can be fed through the cushion and used to strap the child in place and hold the support cushion 20. Part of a typical 3-point belt is indicated in ghost outline at 63 in FIG. 1. At the end of each slit are strain relief holes 62*a* to prevent undesirable propagation of the slit.

The seat cushion area 42 also includes raised marginal portions 64 at the sides (best seen in FIG. 3) to help hold the thighs of the child in neutral rotation and proper alignment. The support cushion is made slightly oversize for a typical stroller so that the cushion overall is somewhat laterally compressed when in position in a stroller. Also, the weight of a child will depress the centre of the seat section at least. These effects tend to cause the marginal portions 64 of the seat cushion area to be raised with respect to the remainder of the seat, contributing to firm retention of the child in the seat and the seat cushion in the stroller 22. A similar effect is encountered in the back cushion area 44.

The back cushion area is of sufficient longitudinal extent to provide support for the head of the child and the back is contoured to provide deep grooves 66 to promote air circulation between the child and the cushion. Contouring of the seat provides similar grooves 68 at the sides.

As noted previously, the support cushion preferably is a one-piece polyethylene foam moulding. It can be seen particularly from FIG. 9 that the rear face of the moulding has recessed areas that match convex contours on the seating surface of the moulding. It has been found that a moulded foam cushion of this form provides a number of advantages, particularly a firm but comfortable base of support to promote longer sitting ability. The foam acts to position, stabilize and prevent unwanted movement of the seat. At the same time, the cushion is lightweight, portable and easy to use. The foam is a closed cell foam which makes the cushion easy to clean and is non-allergenic.

It will of course be appreciated that the preceding description relates to a particular preferred embodiment of the invention and that modifications are possible within the broad scope of the invention. For example, while a one-piece polyethylene foam moulding is preferred, other closed cell foams or even other materials could be used. For example, the cushion could be made as a padded (stuffed) shell. The cushion could be a composite assembled from individual panels or components.

We claim:

1. A support cushion for children's furniture, the cushion defining a seat cushion area and a back cushion area and having a seating surface that extends over said areas and is contoured to provide positional support for a child seated on said cushion, the cushion being flexible to permit variation in relative angular orientation between the seat cushion area and the back cushion area, wherein the seat cushion area includes a raised barrier that extends transversely of the area at a location spaced forwardly of the rear of the seat cushion area for controlling the position of the pelvis of a child using the cushion, and wherein the cushion further includes a pair of side support elements capable of extending forwardly from respectively opposite sides of the back cushion area to locate against sides of the trunk of a child and cushion the trunk against side-to-side movement, and a pelvis support element which extends transversely of the cushion between the seat cushion area and the back cushion area, for providing specific support to the rear of the pelvis of a child using the cushion; wherein the pelvis support element adjoins the seat cushion area and the back cushion area at respective hinge regions that extend transversely of the cushion, allowing longitudinal movement of the cushion with respect to a seating unit in which the cushion is used, whereby the relative longitudinal extents of the seat cushion area and the back cushion area can be varied and the pelvic support element located to a lesser or greater extent below the buttocks of a child seated on the cushion.

2. A support cushion as claimed in claim 1, wherein the seating surface is contoured to provide a raised portion in a central region of a distal portion of the seat cushion area for maintaining separation of the legs of a child using the cushion.

3. A support cushion as claimed in claim 2, further comprising raised marginal areas along respectively opposite sides of the seat cushion area for co-operation with the thighs of a child using the cushion to assist in holding the thighs in neutral rotation and proper alignment.

4. A support cushion as claimed in claim 2, wherein a slit is provided in said raised portion of the seat cushion area for accepting the positioning straps of children's furniture to hold the child and support the cushion in place.

5. A support cushion as claimed in claim 1, wherein the seating surface of the cushion is contoured to provide grooves in the seat cushion area and the back cushion area to allow air circulation between the child and the support cushion.

6. A support cushion as claimed in claim 1 comprising a one-piece closed cell foam moulding.

7. A support cushion as claimed in claim 6, wherein the moulding comprises a closed-cell polyethylene foam.

* * * * *